United States Patent [19]

Poupe

[11] 4,392,625

[45] Jul. 12, 1983

[54] CIRCUIT ARRANGEMENT FOR A TRACK CIRCUIT WITH MULTIPLE SIGNAL SOURCES

[75] Inventor: Oldřich Poupě, Žilina, Czechoslovakia

[73] Assignee: Vysoka skola dopravy a spojov, Žilina, Czechoslovakia

[21] Appl. No.: 250,594

[22] Filed: Apr. 3, 1981

[30] Foreign Application Priority Data

Apr. 4, 1980 [CS] Czechoslovakia ..... 2339-80

[51] Int. Cl.[3] ..... B61L 21/06

[52] U.S. Cl. ..... 246/34 CT; 246/63 R

[58] Field of Search ..... 246/34 CT, 28 R, 34 R, 246/40, 51, 58, 77, 122 R, 128, 129, 130, 182 B, 48, 52, 57, 75, 187 B, 63 R

[56] References Cited

U.S. PATENT DOCUMENTS

| | | | |
|---|---|---|---|
| Re. 27,472 | 9/1972 | Thorne-Booth | 246/34 CT |
| 3,327,111 | 6/1967 | Frech et al. | 246/63 R |
| 3,840,737 | 10/1974 | Hoyler | 246/63 R |
| 4,304,377 | 12/1981 | Pitard | 246/187 B |

*Primary Examiner*—Thomas A. Robinson

[57] ABSTRACT

A track circuit is disclosed and includes rails which are fed from a main signal transmitter and which rails, at an information point a required distance from the transmitter, are shunted by a cross impedance, with which impedance, with respect to the track of the main signal, an additional transmitter of an auxiliary signal and a main receiver for receiving signals from the main and additional transmitter are serially connected. A signal indicating a free track is obtained if the main receiver is energized.

4 Claims, 4 Drawing Figures

CIRCUIT ARRANGEMENT FOR A TRACK CIRCUIT WITH MULTIPLE SIGNAL SOURCES

BACKGROUND OF THE INVENTION

The invention relates to a signal track circuit where the indication of the presence of a rail vehicle is obtained by way of signals transmitted from two or more signal sources.

Currently used parallel track circuits indicating the presence of a rail vehicle at a certain track section, operate on the principle of the receipt of a signal at one end of a track section when that signal is introduced at the opposite end of the particular track section. There is also an arrangement wherein the signal transmitter is at the center of the track section while a receiver is located on each end of the track section, both receivers cooperating when determining whether the section is free or occupied. Track circuits with limiting insulated rail joints are predominantly used where, on electrified tracks and at lengths over 1.5 km, a shunt sensitivity of about 0.1 ohms is achieved. At present track circuits without insulated rail joints are preferred for their increased reliability in operation. They show, however, a number of drawbacks:

- they operate with signal frequencies within a range above 1.0 kHz, making them more sensitive to influences of foreign currents, particularly from traction vehicles,
- they are only effective over a technical length generally shorter than 1.0 km with increased demands on the insulating conditions of the track circuit (insulating conductivity generally lower than 0.5 S/km),
- a low level of shunt sensitivity (0.06 ohm) is exhibited, and
- the accuracy of determination of the operating length is generally worse than 10 m.

SUMMARY OF THE INVENTION

In accordance with the track circuit of this invention, better parameters are obtained by connecting to the rails a main transmitter for the introduction of a main signal to the track circuit and, at a certain distance therefrom at an information point, shunting the rails with a cross impedance, to which, with respect to the circuit path of the main signal, an additional transmitter of an auxiliary signal and a main receiver, for receiving signals from the main and additional transmitters, are serially connected.

By cooperation of the main and additional transmitters, for instance, of harmonic signals with relatively defined phase shifts, a vector sum of signals from both transmitters is obtained. In the case where the track section is free, the signal from the main transmitter is prevailing in the main receiver causing an energizing of this receiver thereby indicating the free track conditions. If the track section is occupied by a vehicle, the influence of the main signal is reduced and the influence of the auxiliary signal increased thereby causing a deenergizing of the receiver and thus an indication of a rail shunt.

Using the described arrangement, a substantially higher shunt sensitivity is obtained for a track circuit limited by insulated rail joints than with a currently used track circuit of the same length. It is further possible to safeguard a reliable operation at substantially lower demands on the conditions of insulation of the track at actually used lengths and a shunt sensitivity of 0.1 ohms.

A track circuit according to this invention without insulated rail joints operates also within the frequency range of 100 Hz, so that it is possible to select a signal frequency within a gap of the interference spectrum of harmonic components of the track current and use a highly selective two-phase receiver. The obtainable technical length is then up to 2.0 km at an insulating conductivity of 1.0 S/km, the mean shunt sensitivity 0.5 ohm and the mean accuracy of determination of the operating length in the order of units of meters.

DESCRIPTION OF THE DRAWINGS

In the attached drawing four examplary embodiments of track circuits according to this invention are indicated.

DESCRIPTION OF THE PREFERRED EMBODIMENT

Figure 1:
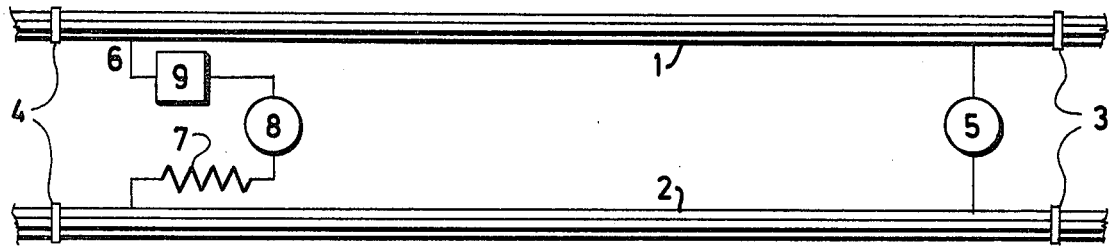
FIG. 1 shows a circuit arrangement for a track circuit with limiting insulated rail joints with a single information point.

The track circuit shown in FIG. 1 comprises a circuit path composed of rails 1,2 limited by two pairs of insulated rail joints 3,4. A main transmitter 5 is connected at one end of the tracks between both rails 1,2 while on the other end of the track at an information point 6, the rails 1,2 are interconnected by a series circuit composed of a cross impedance 7, an additional transmitter 8 and a main reciever 9.

The main signal from the main transmitter 5 causes passage of current through the cross impedance 7. If the additional transmitter 8 is operating on the same frequency as the main transmitter 5, the main and auxiliary signals are superposed at the main receiver 9 and the resulting signal is compared as to magnitude and phase with a reference voltage in the phase dependent main receiver 9. A free track section is indicated by the resulting signal surpassing a predetermined level of the phase-active component in the main receiver 9. In case of the presence of a shunt at any place in the track section, the component from the main transmitter 5 drops in the resulting signal, thereby reducing the resulting signal below the level of the phase-active component then causing the de-energizing of the main receiver.

Figure 2:
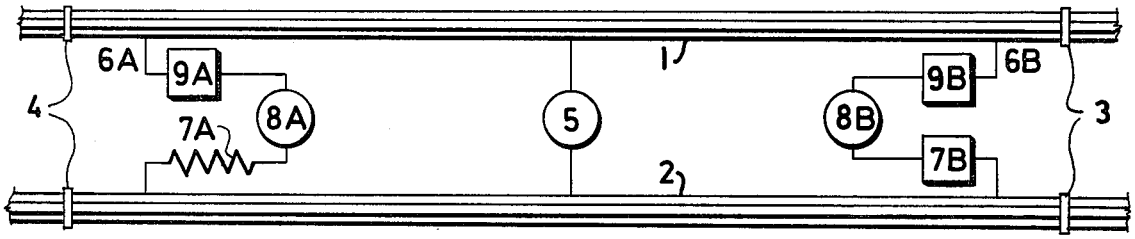
FIG. 2 shows a circuit arrangement similar to FIG. 1 with two information points.

The track circuit shown in FIG. 2 differs from the above-mentioned by doubling the information points 6A, 6B with the respective apparatus, and by situating the main transmitter 5 approximately at the center of the track section with rails 1,2 and insulated rail joints 3,4. Its operation corresponds to that of FIG. 1 with the difference that the main signal from the main transmitter 5 is propagated to both information points 6A, 6B respectively, where it causes passage of the respective currents over the cross impedances 7A, 7B, the additional transmitters 8A, 8B and the main receivers 9A, 9B respectively. In order to indicate a free track section, all receivers must be energized, for indication of a shunt condition, a de-energizing of any one of the receivers is sufficient.

Figure 3:
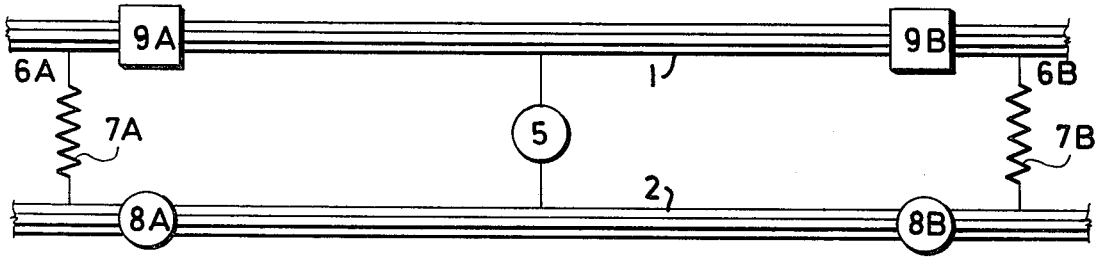
FIG. 3 shows a circuit arrangement of a track circuit with non-insulated rail joints with two information points.

The track circuit shown in FIG. 3 is not limited by the insulated rail joints 3,4. The main transmitter 5 is again approximately at the center between information points 6A and 6B, at which points the rails 1,2 are shunted by cross impedances 7A and 7B. With regard to passage of signal currents, the additional transmitters 8A, 8B, respectively, and the main receivers 9A, 9B, respectively, are connected in series with the cross impedance 7A, 7B, respectively.

The auxiliary signals from the additional transmitters 8A, 8B, respectively, are inductively coupled with the rail 2 and similarly also the resulting signal currents passing respectively through the rail 1 in the information point 6A is inductively coupled with the main receiver 9A, and in the information point 6B with the main receiver 9B. So far, the magnitudes of the cross impedances 7A, 7B, respectively, are close to zero, no mutual influencing of the non-limited track circuit and adjoining track sections takes place and the operation is the same as that of the track circuit in FIG. 2.

Figure 4:
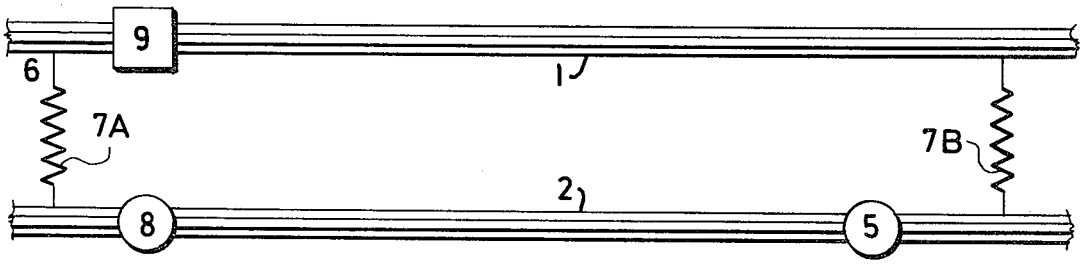
FIG. 4 shows a circuit arrangement similar to FIG. 3 with one information point.

For shorter track sections the arrangement of a non-limited track circuit according to FIG. 4 is advantageous. The interconnection of the apparatus of the information point 6 is the same as in FIG. 3. The main transmitter 5 is however situated at the other end of the track section near the cross impedance 7B and the main signal supplied therefrom is inductively coupled with the rail 2.

The path of the main signal is closed over the rails 1,2 by the cross impedances 7A, 7B. The auxiliary signal from the additional transmitter is inductively coupled with the rail 2. The resulting current, which is inductively coupled with the main receiver 9, passes through rail 1.

The resulting signal current passes in the information point over rails 1 and 2 and it is therefore possible to double alternatively the inductive pick-up means for the main receiver in FIGS. 3 and 4—one picks up the signal from rail 1, the second from rail 2—and the outputs of both pick-up means control the main receiver 9.

Similarly it is possible to double in the same information point, the additional transmitter and couple inductively the auxiliary signal from the first additional transmitter with rail 1 and the auxiliary signal from the second additional transmitter with rail 2 so that both induced voltages are added. Alternatively it is possible to double in FIG. 4 the main transmitter 5 and coupled inductively the partial main signals with both rails near the cross impedance 7B.

In certain cases additional transmitters 8A, 8B, respectively, can be connected in the circuit arrangement of a non-limited track circuit in FIG. 3, in series with the cross impedances 7A, 7B, respectively, directly in the shunt connection of both rails 1,2 at the information points 6A, 6B, respectively.

What is claimed is:

1. A circuit arrangement for determining the presence of a rail vehicle on a section of track having at least two rails, said circuit arrangement comprising a main signal transmitter coupled to said rails for introducing a main signal thereon, a cross impedance shunting said rails, an additional transmitter for supplying an auxiliary signal and a main receiver for receiving the signals from said main and additional transmitters, said additional transmitter and said main receiver being connected in series with respect to the track of the main signal and being positioned along said track section, with said cross impedance, at a first information point located at a predetermined distance from said main transmitter, whereby the presence of a rail vehicle on said track section additionally shunts said rails thereby reducing the level of said main signal which is then indicated by said receiver.

2. A circuit arrangement as claimed in claim 1, which further comprises a further cross impedance, a further additional transmitter and a further main receiver, each being coupled to said rails, as said cross impedance, said additional transmitter and said main receiver, respectively, at a second information point located at a predetermined distance from said main transmitter opposite from said first information point.

3. A circuit arrangement as claimed in claim 1, wherein said main receiver is inductively coupled to at least one of said rails, and wherein said main transmitter is inductively coupled to at least one of said rails, an additional cross impedance being provided at said main transmitter to electrically close said circuit arrangement.

4. A circuit arrangement as claimed in claim 2, wherein said main receivers are inductively coupled to at least one of said rails, and wherein said main transmitter is inductively coupled to at least one of said rails.

* * * * *